US010471580B1

(12) United States Patent
Lies

(10) Patent No.: US 10,471,580 B1
(45) Date of Patent: Nov. 12, 2019

(54) MULTI-PURPOSE TOOL

(71) Applicant: Shelby Lies, Dallas, TX (US)

(72) Inventor: Shelby Lies, Dallas, TX (US)

( * ) Notice: Subject to any disclaimer, the term of this patent is extended or adjusted under 35 U.S.C. 154(b) by 114 days.

(21) Appl. No.: 15/820,878

(22) Filed: Nov. 22, 2017

Related U.S. Application Data

(60) Provisional application No. 62/425,379, filed on Nov. 22, 2016.

(51) Int. Cl.

| | |
|---|---|
| ***B25F 1/04*** | (2006.01) |
| ***A47G 21/06*** | (2006.01) |
| ***B25F 3/00*** | (2006.01) |
| ***B26B 11/00*** | (2006.01) |

(52) U.S. Cl.
CPC ..... *B25F 1/04* (2013.01); *A47G 21/06* (2013.01); *B25F 3/00* (2013.01); *B26B 11/008* (2013.01)

(58) Field of Classification Search
CPC ... B25F 1/04; B25F 3/00; A47G 21/06; B26B 11/008; B67B 7/38; B67B 7/385; B67C 7/38; B67C 7/385
USPC ..... 7/113; 30/147
See application file for complete search history.

(56) References Cited

U.S. PATENT DOCUMENTS 844,603 A * 2/1907 Massey ..... B67B 7/38 30/143
4,922,611 A * 5/1990 Levy ..... A47G 21/08 30/147
5,511,261 A * 4/1996 Collins ..... B25B 13/56 30/162
7,089,834 B2 * 8/2006 Reynertson ..... B25B 23/14 73/862.23
7,373,681 B2 * 5/2008 Elsener ..... B25F 1/04 7/118
8,397,737 B2 * 3/2013 Evans ..... A45B 9/00 135/65
2010/0269648 A1 * 10/2010 Fenstemaker ..... B25F 1/02 81/491
2011/0271779 A1 * 11/2011 Corcoran ..... F16H 25/20 74/89.23
2016/0089198 A1 * 3/2016 Arya ..... A61B 18/1445 600/317
2017/0086496 A1 * 3/2017 Cameron ..... B25F 1/04

* cited by examiner

*Primary Examiner* — Hadi Shakeri
(74) *Attorney, Agent, or Firm* — Eldredge Law Firm, LLC; Richard Eldredge; Beth Felix

(57) ABSTRACT

A multi-purpose tool includes a hollow elongated body with an open end providing access to a cavity within the elongated body; a first tool secured within the cavity and having a first head connected to a first extendable rod; a second tool secured within the cavity and having a second head connected to a second extendable rod; a motor connected to the first tool and second tool and to extend and retract the first extendable rod and the second extendable rod; a control center to control the motor, the control center having a first switch for operating the motor in connection with the first tool; and a second switch for operating the motor in connection with the second tool; a power source secured within the cavity and adapted to provide power to the motor; activation of the first switch causes the motor to extend the first extendable rod, wherein the first head is extended past the open end; and activation of the second switch causes the motor to extend the second extendable rod, wherein the second head is extended past the open end.

14 Claims, 5 Drawing Sheets

MULTI-PURPOSE TOOL

BACKGROUND

1. Field of the Invention

The present invention relates generally to handheld tools, and more specifically, to a multi-purpose tool with varying functional tool heads.

2. Description of Related Art

Handheld tools are well known in the art and are effective means to aid in varying tasks. For example, FIG. 1 depicts a plurality of conventional handheld tools, including a fork 101, a knife 103, and a spoon 105. During use, a user alternates between fork 101, knife 103, and spoon 105 as necessary for eating.

One of the problems commonly associated with fork 101, knife 103, and spoon 105 is inconvenience. For example, a user must constantly switch between each tool while eating.

Accordingly, although great strides have been made in the area of handheld tools, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
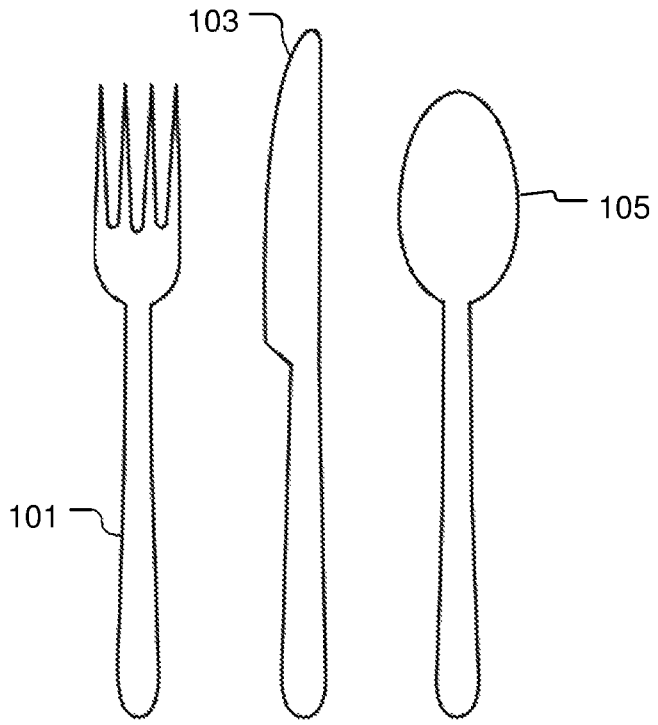
FIG. 1 (Prior Art)
FIG. 1 is a front view of a plurality of conventional handheld tools.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional handheld tools. Specifically, the present invention provides a means to conveniently have access to a plurality of tools within one hand-held device. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
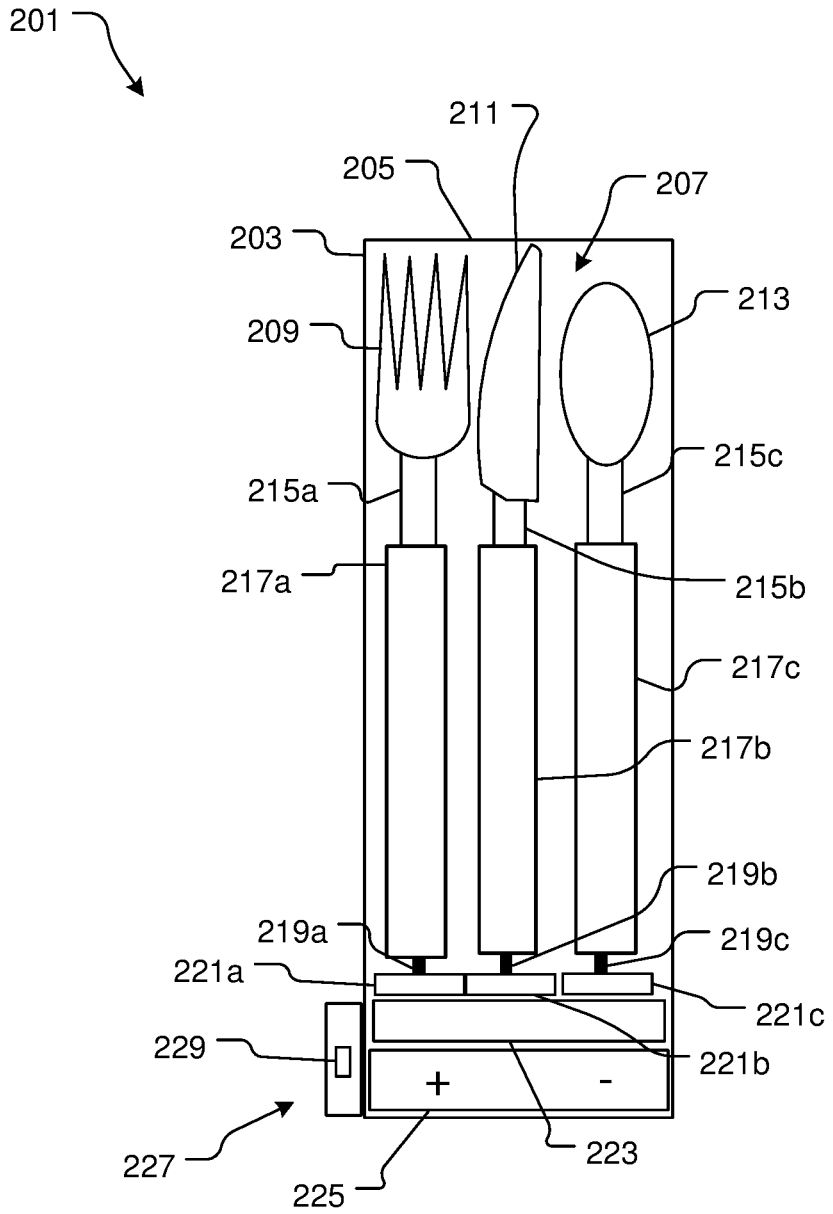
FIG. 2 is a front view of a multi-purpose tool in accordance with a preferred embodiment of the present application.

Referring now to the drawings wherein like reference characters identify corresponding or similar elements throughout the several views, FIG. 2 depicts a front view of a multi-purpose handheld tool 201 in accordance with a preferred embodiment of the present application. It will be appreciated that tool 201 overcomes one or more of the above-listed problems commonly associated with conventional handheld tools.

In the contemplated embodiment, tool 201 includes an elongated body 203 with an open end 205 providing access to a cavity 207. The cavity 207 houses a plurality of tool heads 209, 211, 213 connected to inner members 215*a*, 215*b*, 215*c* telescopically engaged with outer members 217*a*, 217*b*, 217*c*. The inner members 215*a-c* are in communication with driving screws 219*a*, 219*b*, 219*c* in further communication with gears 221*a*, 221*b*, 221*c*. The gears 221*a-c* are activated by a motor 223 in communication with a power source 225 and a control center 227, the control center 227 having one or more switches 229.

Figure 3:
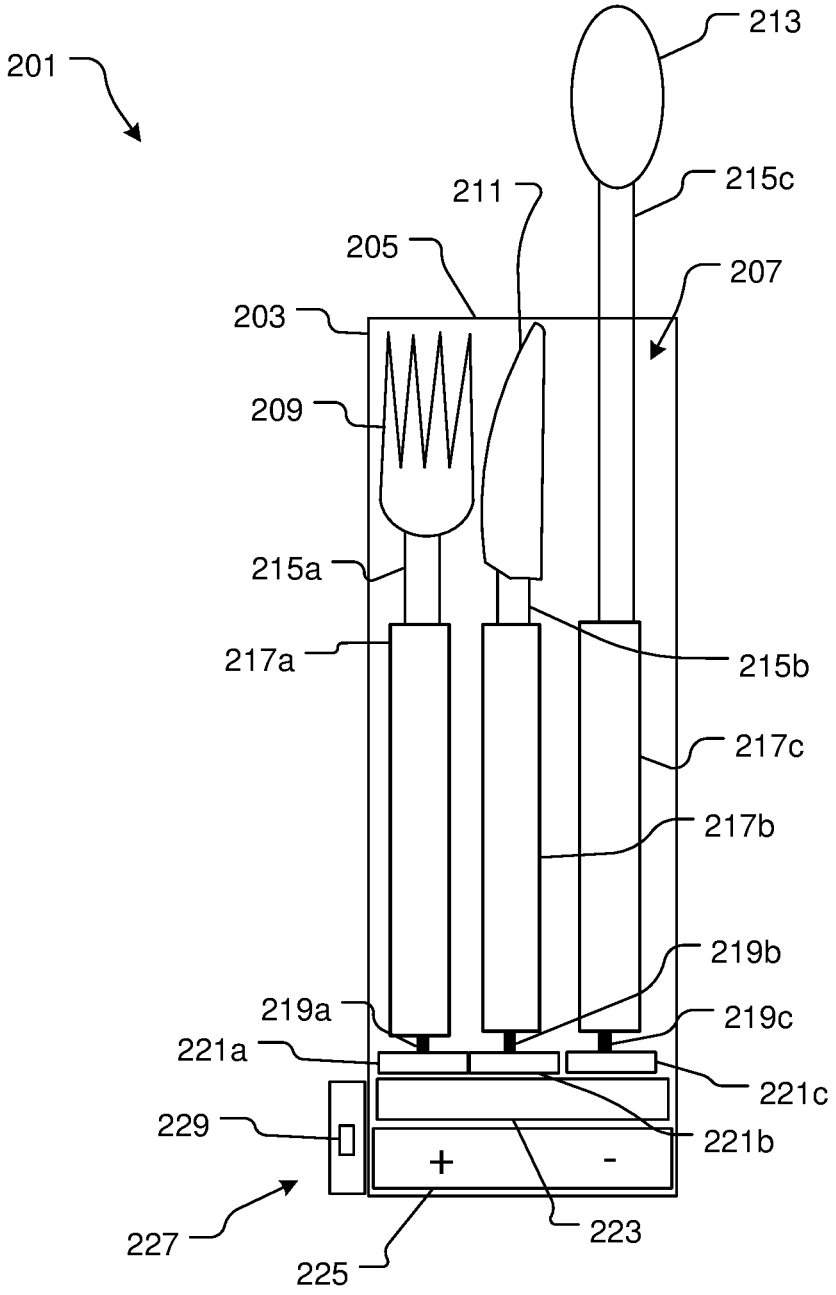
FIG. 3 is a front view of the multi-purpose tool from FIG. 2.

In FIG. 3. tool 201 is shown with a tool head 213 extended. During use, the user activates the motor 223, causing a gear 221*c* to turn and thereby raising tool head 213 above the open end 205, allowing for use of tool head 213.

It should be appreciated that one of the unique features believed characteristic of the present application is the electrically operated extension of the tool heads 209,211, 213. It should be appreciated that this feature provides a multi-purpose hand held tool with improved functionality and convenience, by allowing for multiple tool heads to be combined into one tool and easily accessed.

As shown in FIG. 2 and FIG. 3, one contemplated set of tool heads includes eating utensils such as forks, knives, and spoons.

Figure 4A:
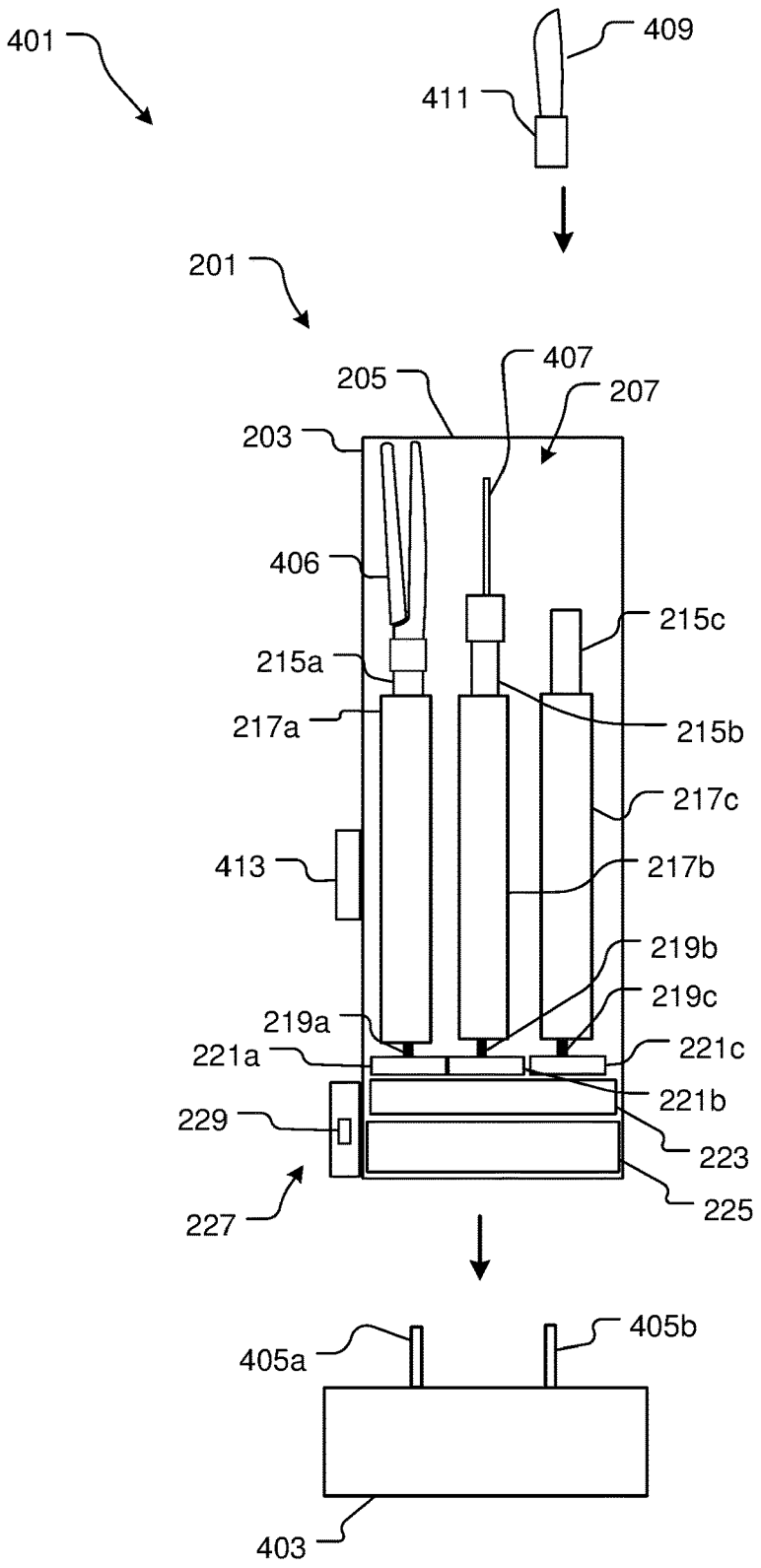
FIGS. 4A and 4B are front views of a multi-purpose tool system with an alternative embodiment of the multi-purpose tool of FIG. 2.
Figure 4B:
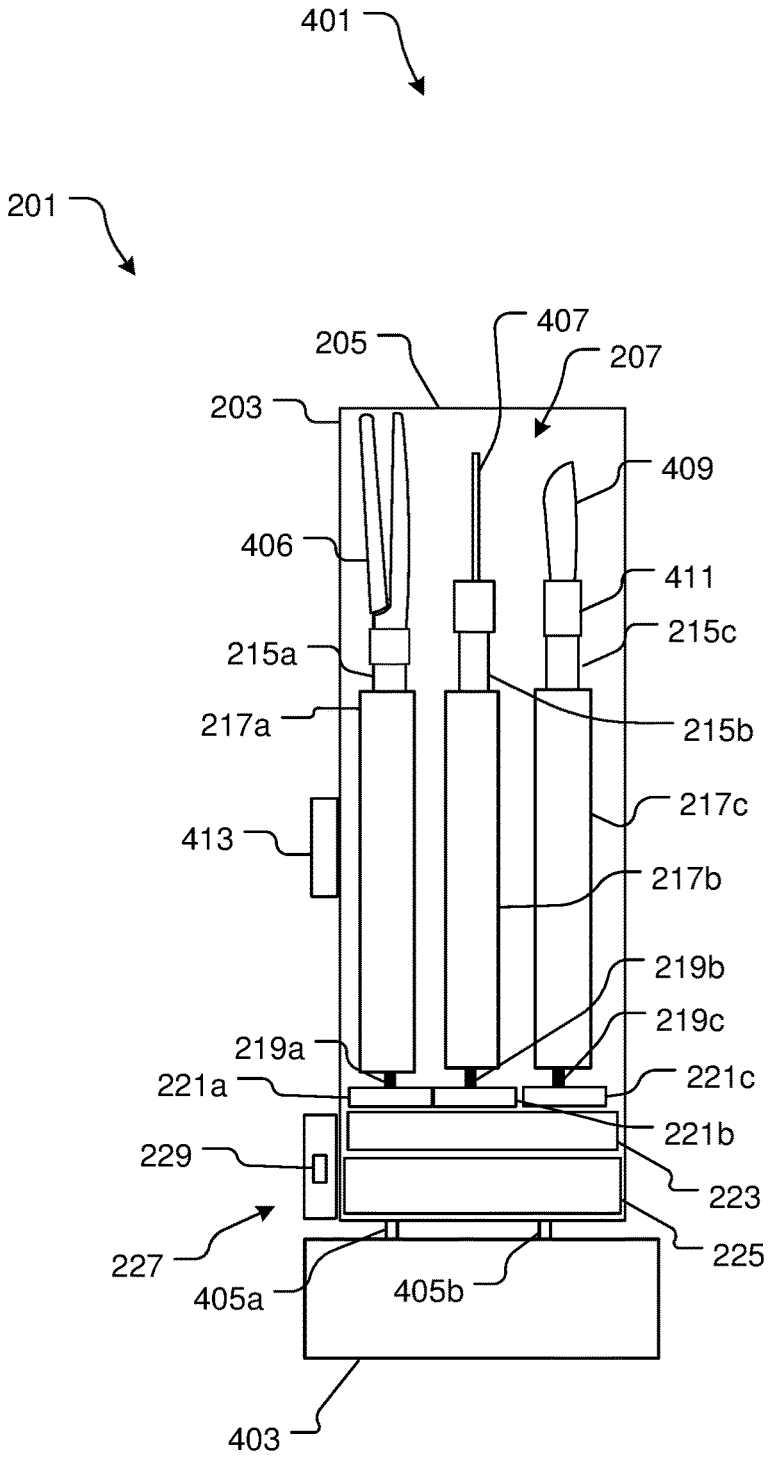

In FIGS. 4A and 4B front views a multi-purpose tool system 401 are shown. System 401 includes an alternative embodiment of a multi-purpose tool 201 and a docking station 403, wherein the multi-purpose tool 201 is configured to secure to one or more prongs 405*a*, 405*b* of the docking station 403, and the docking station 403 is configured to charge the power source 225.

In the alternative embodiment, tool 201 includes surgical tool heads including forceps 406, an electrocautery tool 407, and a scalpel 409, wherein the scalpel 409 head is removable and replaceable by a connection means 411 such as a threaded connection. It is contemplated that forceps 406 and electrocautery tool 407 can be controlled by the control center 227, wherein the power source 225 provides power to open and close the forceps 406 and activate the electrocautery tool 407. In addition, tool 201 can include a safety mechanism 413 to prevent undesired activation of the motor 223. One contemplated safety mechanism 413 is a button that prevents motor activation when unengaged. A second contemplated safety mechanism 413 is a positional sensor, whereby the motor 223 can only be activated when tool 201 is held in a predetermined position.

It is further contemplated that the control center 227 can be incorporated into a touch screen, whereby the user can extend tools, retract tools, and activate tools through the touch screen. In addition, it should be appreciated that additional features, such as automated selection of tool heads based on a gyroscopic sensor of tool position and/or the customization based on user data can be incorporated into tool 201 through the control center 227. For example, it is contemplated that the control center can collect user data, such as collect data when the user activates a specific tool. In addition, the control center can be pre-programmed with the gyroscopic sensor, thereby allowing for automatic activation of one or more tools based on the data collected and the pre programming of the control center.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A multi-purpose tool, comprising:

a hollow elongated body with an open end providing access to a cavity within the elongated body;

a first tool secured within the cavity and having a first head connected to a first extendable rod, the first tool having a first connection device, the first connection device is configured to releasably engage with the first extendable rod;

a second tool secured within the cavity and having a second head connected to a second extendable rod, the second tool having a second connection device, the second connection device is configured to releasably engage with the second extendable rod;

a motor connected to the first tool and the second tool and configured to extend and retract the first extendable rod and the second extendable rod;

a control center configured to control the motor, the control center having:

a first switch for operating the motor in connection with the first tool;

a second switch for operating the motor in connection with the second tool; and a position sensor secured to the hollow elongated body, the position sensor is configured to activate the motor as the hollow elongated body is held in a predetermined position;

a power source secured within the cavity and adapted to provide power to the motor;

wherein activation of the first switch causes the motor to extend the first extendable rod, wherein the first head is extended past the open end; and wherein activation of the second switch causes the motor to extend the second extendable rod, wherein the second head is extended past the open end.

2. The multi-purpose tool of claim 1, wherein the first extendable rod comprises:

a hollow outer member;

an inner member telescopically engaged within the outer member;

a driving screw engaged with the inner member; and a gear coupled to the motor and rotationally engaged with the driving screw;

wherein the motor rotates the gear, causing the driving screw to telescopically raise the inner member, thereby extending the first head above the open end of the hollow elongated body.

3. The multi-purpose tool of claim 1, wherein the first head and second head are eating utensils.

4. The multi-purpose tool of claim 1, wherein the first head and second head are surgical tools.

5. The multi-purpose tool of claim 4, wherein the surgical tools comprise one or more of:

a forceps tool;

a scalpel tool; and an electrocautery tool.

6. The multi-purpose tool of claim 5, wherein the scalpel tool is removable and replaceable by a connection device on the first extendable rod.

7. The multi-purpose tool of claim 1, further comprising a safety mechanism.

8. The multi-purpose tool of claim 7, wherein the safety mechanism is a button configured to prevent activation of the motor when released and allow activation of the motor when engaged.

9. The multi-purpose tool of claim 7, wherein the safety mechanism is a positional sensor, configured to prevent activation of the motor when the multi-purpose tool is in a predetermined position as determined by the positional sensor.

10. The multi-purpose tool of claim 1, wherein the control center is a touch screen with access to the first switch and the second switch.

11. The multi-purpose tool of claim 1, wherein the power source is a battery.

12. The multi-purpose tool of claim 1, further comprising:

a gyroscope sensor disposed within the hollow elongated body.

13. The multi-purpose tool of claim 1, wherein the control center is configured to collect user data and extend the first tool as appropriate to the collection of user data.

14. A multi-purpose tool system, comprising:

the multi-purpose tool of claim 1;

a docking station with an electricity supply and configured to receive the hollow elongated body by one or more prongs; and wherein the docking station is configured to charge the power source.

* * * * *